US012805568B2

(12) United States Patent
Bessant et al.

(10) Patent No.: US 12,805,568 B2
(45) Date of Patent: Nov. 24, 2026

(54) AEROSOL-GENERATING DEVICE WITH THERMALLY INSULATED HEATER

(71) Applicant: Philip Morris Products S.A., Neuchatel (CH)

(72) Inventors: Michel Bessant, Neuchâtel (CH); Silviu Natanael Pantea, Neuchâtel (CH); Johannes Petrus Maria Pijnenburg, Neuchâtel (CH); Jun Wei Yim, Colombier (CH); Grégori Ischi, Bole (CH); Jun Jie How, Muar (MY); Dennis Yape Dela Paz, General Trias Cavite (PH)

(73) Assignee: Philip Morris Products S.A., Neuchatel (CH)

( * ) Notice: Subject to any disclaimer, the term of this patent is extended or adjusted under 35 U.S.C. 154(b) by 600 days.

(21) Appl. No.: 18/250,153

(22) PCT Filed: Oct. 25, 2021

(86) PCT No.: PCT/EP2021/079557
§ 371 (c)(1),
(2) Date: Apr. 21, 2023

(87) PCT Pub. No.: WO2022/090164
PCT Pub. Date: May 5, 2022

(65) Prior Publication Data

US 2023/0389608 A1 Dec. 7, 2023

(30) Foreign Application Priority Data

Oct. 28, 2020 (EP) ..... 20204492

(51) Int. Cl.
*A24F 40/46* (2020.01)

(52) U.S. Cl.
CPC ..... *A24F 40/46* (2020.01)

(58) Field of Classification Search
None
See application file for complete search history.

(56) References Cited

U.S. PATENT DOCUMENTS

2014/0305449 A1* 10/2014 Plojoux ..... A24F 40/46 131/328
2014/0360515 A1 12/2014 Vasiliev et al.
(Continued)

FOREIGN PATENT DOCUMENTS

CN 110859332 A 3/2020
EA 000244 B1 2/1999
(Continued)

OTHER PUBLICATIONS

Translation of WO 2019/126997 (Year: 2019).*
(Continued)

*Primary Examiner* — Cynthia Szewczyk
(74) *Attorney, Agent, or Firm* — Oblon, McClelland, Maier & Neustadt, L.L.P.

(57) ABSTRACT

A heater assembly for an aerosol-generating device is provided, including: a heating chamber configured to heat an aerosol-forming substrate; a heater casing arranged around the heating chamber, the heater casing being arranged radially distanced from the heating chamber; a first connecting wall and a second connecting wall; and an air-tight hollow space defined between the heating chamber, the heater casing, and the first and the second connecting walls, the air-tight hollow space being filled with a gaseous composition at ambient pressure, and a heating element being arranged at least partly around the heating chamber. An aerosol-generating device including the heater assembly, and an aerosol-generating system including the aerosol-generating device and the aerosol-forming substrate, are also provided.

18 Claims, 5 Drawing Sheets

(56) References Cited

U.S. PATENT DOCUMENTS

| | | | | |
|---|---|---|---|---|
| 2016/0255879 | A1 | 9/2016 | Paprocki et al. | |
| 2016/0360794 | A1 | 12/2016 | Li et al. | |
| 2020/0281273 | A1* | 9/2020 | Kim | A24D 1/20 |
| 2021/0307398 | A1 | 10/2021 | Paprocki et al. | |
| 2021/0352966 | A1 | 11/2021 | Reevell | |
| 2022/0225668 | A1* | 7/2022 | Capelli | A24F 40/20 |

FOREIGN PATENT DOCUMENTS

| | | | | |
|---|---|---|---|---|
| EP | 3871535 | A1 * | 9/2021 | A24F 40/46 |
| JP | 2014-518095 | A | 7/2014 | |
| JP | 2016-534730 | A | 11/2016 | |
| JP | 2020-528277 | A | 9/2020 | |
| RU | 2 595 971 | C2 | 8/2016 | |
| RU | 2 604 022 | C2 | 12/2016 | |
| TW | 202019300 | A | 6/2020 | |
| WO | WO 2013/034454 | A1 | 3/2013 | |
| WO | WO 2015/062983 | A1 | 5/2015 | |
| WO | WO 2019/126997 | A1 | 7/2019 | |
| WO | WO 2020/025746 | A1 | 2/2020 | |
| WO | WO 2020/074601 | A1 | 4/2020 | |
| WO | WO 2020/074602 | A1 | 4/2020 | |
| WO | WO 2020/084758 | A1 | 4/2020 | |
| WO | WO 2020/182746 | A1 | 9/2020 | |

OTHER PUBLICATIONS

International Search Report and Written Opinion issued Jan. 21, 2022 in PCT/EP2021/079557 filed Oct. 25, 2021, 13 pages.

Combined Russian Office Action and Search Report issued Oct. 20, 2023 in Russian Patent Application No. 2023113603/03 (submitting English Translation only), 7 pages.

Japanese Office Action issued Apr. 30, 2024 in Japanese Patent Application No. 2023-521842, 4 pages.

Russian Office Action issued Mar. 4, 2024 in Russian Patent Application No. 2023113603/03, 9 pages.

Korean Office Action issued Aug. 7, 2025, in corresponding Korean Patent Application No. 10-2023-7014037 (with English Translation), 12 pages.

Office Action dated Feb. 27, 2026, issued in corresponding Chinese patent application No. 202180065065.2 (with English translation).

* cited by examiner

AEROSOL-GENERATING DEVICE WITH THERMALLY INSULATED HEATER

The present disclosure relates to a heater assembly for an aerosol-generating device. The present disclosure further relates to an aerosol-generating device. The present disclosure further relates to an aerosol-generating system comprising an aerosol-generating device and an aerosol-forming substrate.

It is known to provide an aerosol-generating device for generating an inhalable vapor. Such devices may heat an aerosol-forming substrate contained in an aerosol-generating article without burning the aerosol-forming substrate. The aerosol-generating article may have a rod shape for insertion of the aerosol-generating article into a heating chamber of the aerosol-generating device. A heating element is typically arranged in or around the heating chamber for heating the aerosol-forming substrate once the aerosol-generating article is inserted into the heating chamber of the aerosol-generating device.

Heat produced by the heating element may inadvertently be dissipated away from the heating chamber. Heat may be dissipated to the environment or to other components of the aerosol-generating system. Heat may inadvertently be dissipated away from the heating chamber via free air convection. Heat may inadvertently be dissipated away from the heating chamber by heat conduction via components of the aerosol-generating device. Heat may inadvertently be dissipated away from the heating chamber by heat conduction via components of the aerosol-generating article, for example via the aerosol-forming substrate. Heat dissipation away from the heating chamber may cause heating of components of the device that are not intended to be heated. For example, a housing of the device to be grasped by a user may become uncomfortably hot. Heat dissipation away from the heating chamber may cause heat losses within the heating chamber. Heat losses within the heating chamber may result in a less efficient heating. An excess amount of energy may be required to heat the heating chamber to a desired temperature.

It would be desirable to have an aerosol-generating device that may reduce heat losses from the heating chamber. It would be desirable to thermally insulate the heating chamber with respect to other components of the aerosol-generating device. It would be desirable to have an aerosol-generating device that may reduce heating up of the outer housing of the device to be grasped by a user. It would be desirable to have an aerosol-generating device that may provide effective thermal insulation. It would be desirable to have an aerosol-generating device that may provide thermal insulation at low manufacturing costs. It would be desirable to have an aerosol-generating device that may provide lightweight thermal insulation.

According to an embodiment of the invention there is provided a heater assembly for an aerosol-generating device. The heater assembly may comprise a heating chamber for heating an aerosol-forming substrate. The heater assembly may comprise a heater casing. The heater casing may be arranged around the heating chamber. The heater casing may be arranged radially distanced from the heating chamber. The heater assembly may comprise a first connecting wall. The heater assembly may further comprise a second connecting wall. The heater assembly may comprise an air-tight hollow space. The air-tight hollow space may be defined between the heating chamber, the heater casing, and the first and second connecting walls.

According to an embodiment of the invention there is provided a heater assembly for an aerosol-generating device. The heater assembly comprises a heating chamber for heating an aerosol-forming substrate. The heater assembly further comprises a heater casing. The heater casing is arranged around the heating chamber. The heater casing is further arranged radially distanced from the heating chamber. The heater assembly further comprises a first connecting wall and a second connecting wall. The heater assembly further comprises an air-tight hollow space. The air-tight hollow space is defined between the heating chamber, the heater casing, and the first and second connecting walls.

Advantageously, thermal losses due to air circulation between the interior of the heater casing and the outside air may be reduced or avoided, for example, due at least in part to providing an air-tight hollow space around the heating chamber. Providing an air-tight hollow space around the heating chamber may also help to reduce or avoid thermal losses due to air convection within the air-tight hollow space. Advantageously, by providing an air-tight hollow space around the heating chamber, thermal insulation of the heating chamber with respect to the outer surface of the heater casing may be provided. By providing an air-tight hollow space around the heating chamber, a heater assembly for an aerosol-generating device is provided that may reduce heat losses from the heating chamber. Providing an air-tight hollow space around the heating chamber, a heater assembly for an aerosol-generating device is provided that may reduce heating up of the outer housing of the device to be grasped by a user. By providing an air-tight hollow space around the heating chamber, a heater assembly for an aerosol-generating device is provided that may provide effective thermal insulation. By providing an air-tight hollow space around the heating chamber, a heater assembly for an aerosol-generating device is provided that may provide thermal insulation at low manufacturing costs. Due to providing an air-tight hollow space around the heating chamber, a heater assembly for an aerosol-generating device is provided that may provide lightweight thermal insulation.

As used herein, the terms "upstream" and "front", and "downstream" and "rear", are used to describe the relative positions of components, or portions of components, of the aerosol-generating device in relation to the direction in which airflows through the aerosol-generating device during use thereof. Aerosol-generating devices according to the invention comprise a proximal end through which, in use, an aerosol exits the device. The proximal end of the aerosol-generating device may also be referred to as the mouth end or the downstream end. The mouth end is downstream of the distal end. The distal end of the aerosol-generating article may also be referred to as the upstream end. Components, or portions of components, of the aerosol-generating device may be described as being upstream or downstream of one another based on their relative positions with respect to the airflow path of the aerosol-generating device.

A proximal end of the heater assembly according to the invention is configured to be arranged within an aerosol-generating device in a direction towards the mouth end or downstream end of the device. A distal end of the heater assembly according to the invention is configured to be arranged within an aerosol-generating device in a direction towards the distal end or upstream end of the device. A longitudinal axis of the heating chamber may extend between the proximal end of the heating chamber and the distal end of the heating chamber. A longitudinal axis of the heating chamber may extend between the proximal end of the heater assembly and the distal end of the heater assembly.

The heater casing is arranged radially distanced from the heating chamber at a distance d. The distance d may be measured in a direction orthogonal to the longitudinal axis of the heating chamber. The heating chamber may comprise a wall of the heating chamber. The heater casing may comprise a wall of the heater casing. The distance d may be measured in a radial direction between the wall of the heating chamber and the wall of the heater casing. The distance d may be measured in a radial direction between an outer side of the wall of the heating chamber and an inner side of the wall of the heater casing.

The distance d between the heating chamber and the heater casing may be between 2.5 millimeters and 7 millimeters. The distance between the heating chamber and the heater casing may be between 3.5 millimeters and 6 millimeters, preferably about 4.6 millimeters.

When providing a distance d as described above, air, or another gaseous composition, enclosed within the air-tight hollow space may be considered as still air. Still air, or non-moving air, additionally reduces air convection within the air-tight hollow space. Thereby, thermal losses due to air convection within the air-tight hollow space may be additionally reduced. Thermal insulation may be additionally improved. It has been found that the distance d as described above sufficiently reduces thermal losses. It has moreover been found that the distance d as described above is particularly effective in conjunction with a gaseous composition utilized in the air-tight hollow space as described in more detail below. Preferably, the usage of ambient air in the air-tight hollow space together with the distance d as described above leads to a cost effective and efficient thermal insulation.

Each of the first and second connecting walls may extent between the wall of the heating chamber and the wall of the heater casing. The first and second connecting walls may sealingly connect the heater casing with the outer wall of the heating chamber. The connecting walls may be oriented perpendicular to the longitudinal axis of the heating chamber. The first connecting wall may be a proximal connecting wall. The second connecting wall may be a distal connecting wall.

As used herein the term "hollow space" relates to a volume which is substantially free of a solid material, i.e. which is not filled with solid compounds or substances. In other words, the term "hollow space" relates to a volume which may be filled with a gaseous composition but which is otherwise empty. The air-tight hollow space is hermetically sealed from the outside air. In other words, the interior of the air-tight hollow space is not in fluid connection with the outside air. Thereby, thermal losses due to circulation of gases between the air-tight hollow space and the air outside of the heater assembly may be avoided.

Known thermal insulations with good thermal insulation properties often require solid materials like aerogels. Known thermal insulations may be complicated to manufacture. Known thermal insulations may be costly to manufacture. The heater assembly comprising the air-tight hollow space may be less complicated to manufacture when compared to a heater assembly requiring an additional solid material to be arranged around the heating chamber. The air-tight hollow space may be less costly when compared to a solid material, for example an aerogel. The air-tight hollow space may have a lower thermal conductivity when compared to a solid material. Thereby, a better thermal insulation may be provided. The air-tight hollow space may have a lower mass when compared to a solid material. Thereby, a more lightweight thermal insulation may be provided.

The air-tight hollow space may be filled with a gaseous composition. The air-tight hollow space may be filled with a gaseous composition at about ambient pressure. The gas pressure within the air-tight hollow space may be between 0.9 bar and 1.1 bar, preferably about 1.0 bar. The air-tight hollow space may be filled with a gaseous composition at about ambient pressure at about 20 degrees Celsius. Temperature-dependent variations of the gas pressure within the air-tight hollow space may occur, as known to those skilled in the art.

The gaseous composition may comprise an inert gas. The gaseous composition may comprise one or more of nitrogen and argon. The gaseous composition may have the composition of ambient air. The gaseous composition may comprise about 80 percent of nitrogen and about 20 percent of oxygen. The air-tight hollow space may be filled with ambient air.

The gaseous composition may have the composition of ambient air at ambient pressure. The gaseous composition having the composition of ambient air at ambient pressure brings the advantage that the heater assembly comprising the air-tight hollow space may be manufactured under ambient conditions. Use of additional gases or vacuum techniques may be avoided. The heater assembly may thus be manufactured in a cost-effective way.

The gaseous composition within the air-tight hollow space may be less expensive when compared to a solid material, for example an aerogel. The gaseous composition within the air-tight hollow space may have a lower thermal conductivity when compared to a solid material. Thereby, a better thermal insulation may be provided. The gaseous composition within the air-tight hollow space may have a lower mass when compared to a solid material. Thereby, a more lightweight thermal insulation may be provided.

Known thermal insulations with good thermal insulation properties often require a vacuum. It may be less costly to manufacture a heater assembly with an air-tight hollow space filled with a gaseous composition, preferably ambient air, in comparison to an evacuated hollow space. Vacuum-based thermal insulations may be more complicated to manufacture. Vacuum-based thermal insulations may be more costly to manufacture.

The heater casing may comprise a wall of the heater casing. The wall of the heater casing may have an outer side facing towards the exterior of the heater assembly. The wall of the heater casing may have an inner side facing towards the interior of the heater assembly. The inner side of the wall of the heater casing may face towards the heating chamber.

The thickness of the wall of the heater casing may be below about 2 millimeters. The thickness of the wall of the heater casing may be below 1 millimeter, preferably about 0.8 millimeter. The thickness of one or both of the first and second connecting walls may be below 1 millimeter, preferably about 0.8 millimeter. Having such thin walls, the thermal mass of the heater casing may be minimized. This may additionally reduce heat losses from the heating chamber.

One or more of the wall of the heater casing and the first and second connecting walls may be made of a low thermal conductivity material. This may additionally reduce heat losses from the heating chamber. The wall of the heater casing may comprise or may be made of a plastic material. The first and second connecting walls may comprise or may be made of a plastic material. The plastic material may comprise one or both of a polyaryletherketone (PAEK), a polyether ether ketone (PEEK), and a polyphenylene sulfone (PPSU). Preferably, the plastic material comprises a polyphenylene sulfone (PPSU).

The inner side of the wall of the heater casing may comprise a metal coating. The inner side of one or both of the first and second connecting walls may comprise a metal coating. The metal coating may reduce the emissivity of the inner side of the wall. For example, the emissivity of a PEEK wall may be reduced from about 0.95 to about 0.4. The metal coating may reflect heat radiation emitted from the heating chamber. The metal coating may provide additional heat insulation of the heating chamber with respect to the outside of the heater casing. The metal coating may be a low emissivity metal coating. The metal coating may comprise one or more of aluminium, gold, and silver.

The heating chamber may be configured for receiving an aerosol-forming substrate. The heating chamber may comprise a cavity into which the aerosol-forming substrate may be inserted. The aerosol-forming substrate may be part of an aerosol-generating article. The heating chamber may comprise an opening at a proximal end of the heating chamber for receiving the aerosol-forming substrate. The opening may also serve as an air outlet. The heating chamber may comprise an air inlet at a distal end of the heating chamber.

The heating chamber may have an elongate shape. A longitudinal axis of the heating chamber may extend between the proximal end and the distal end of the heating chamber.

The heating chamber may be a hollow tube. The hollow tube may be formed from a wall of the heating chamber. The wall of the heating chamber may comprise or may be made a metal or an alloy. The wall of the heating chamber may comprise or may be made of stainless steel.

The heater casing may be coaxially aligned around the heating chamber. The heating chamber and the heater casing may have matching shapes. The matching shapes may allow to provide a constant radial distance d between the heater casing and the heating chamber.

The wall of the heater casing may match the shape of the wall of the heating chamber along the longitudinal axis of the heating chamber such that the distance d may be approximately constant. For example, the heating chamber may be a hollow tube and the wall of the heater casing may be a cylindrical wall being coaxially aligned around the heating chamber. The distance d may be measured in a radial direction between the outer diameter of the hollow tube of the heating chamber and the inner diameter of the cylindrical wall of the heater casing. For example, the heating chamber may be a hollow truncated cone and the wall of the heater casing may be a coaxially aligned conical wall. The skilled person will understand that other types of matching shapes will be possible. For example, the matching shapes may be curved or wavy, or may comprise a combination of different shapes along the longitudinal axis of the heating chamber.

The heating chamber and the heater casing may have deviating shapes. The shape of the wall of the heater casing may, to some extent, deviate from the shape of the wall of the heating chamber along the longitudinal axis of the heating chamber. The shape of the wall of the heater casing may deviate from the shape of the wall of the heating chamber along the longitudinal axis of the heating chamber such that the distance d does not vary by more than 1 millimeter along the longitudinal axis of the heating chamber. For example, the heating chamber may be a right circular hollow cylinder and the wall of the heater casing may be a slightly conical hollow cylinder being coaxially aligned around the heating chamber. Due to the conical shape of the wall of the heater casing, the distance d may vary along the longitudinal axis of the heating chamber by not more than 1 millimeter.

An external diameter of the heater casing may be measured in a direction orthogonal to the longitudinal axis of the heating chamber. An external diameter of the heater casing may be between 12 millimeters and 20 millimeters, preferably about 17 millimeters.

An external diameter of the heating chamber may be measured in a direction orthogonal to the longitudinal axis of the heating chamber. A ratio of an external diameter of the heater casing to an external diameter of the heating chamber may be between 2 and 3.5, preferably about 2.75.

The heating chamber may comprise a heating element.

The heating element may be arranged at least partly around the heating chamber. The heating element may be arranged at least partly around the wall of the heating chamber. Preferably, the heating element is arranged fully coaxially surrounding the outer perimeter of the wall of the heating chamber. The heating element may be arranged along at least a part of the longitudinal axis of the heating chamber.

The heating element may comprise one or more electrically conductive tracks on an electrically insulating substrate. The one or more electrically conductive tracks may be resistive heating tracks. The one or more electrically conductive tracks may be configured as a susceptor to be inductively heated. The electrically insulating substrate may be a flexible substrate.

The heating element may be flexible and may be wrapped around the heating chamber. The heating element may be arranged between the heating chamber and the heater casing.

In all of the aspects of the disclosure, the heating element may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics.

As described, in any of the aspects of the disclosure, the heating element may be part of the heating chamber of the heater assembly for an aerosol-generating device. The heater assembly may comprise an internal heating element or an external heating element, or both internal and external heating elements, where "internal" and "external" refer to the aerosol-forming substrate. An internal heating element may take any suitable form. For example, an internal heating element may take the form of a heating blade. Alternatively, the internal heater may take the form of a casing or substrate having different electro-conductive portions, or an electrically resistive metallic tube. Alternatively, the internal heating element may be one or more heating needles or rods that run through the center of the aerosol-forming substrate. Other alternatives include a heating wire or filament, for example a Ni—Cr (Nickel-Chromium), platinum, tungsten or alloy wire or a heating plate. Optionally, the internal heating element may be deposited in or on a rigid carrier material. In one such embodiment, the electrically resistive heating element may be formed using a metal having a defined relationship between temperature and resistivity. In such an exemplary device, the metal may be formed as a track on a suitable insulating material, such as ceramic material, and then sandwiched in another insulating material, such as a glass. Heaters formed in this manner may be used to both heat and monitor the temperature of the heating elements during operation.

An external heating element may take any suitable form. For example, an external heating element may take the form of one or more flexible heating foils on a dielectric substrate, such as polyimide. The flexible heating foils can be shaped to conform to the perimeter of the substrate receiving cavity. Alternatively, an external heating element may take the form of a metallic grid or grids, a flexible printed circuit board, a molded interconnect device (MID), ceramic heater, flexible carbon fibre heater or may be formed using a coating technique, such as plasma vapour deposition, on a suitable shaped substrate. An external heating element may also be formed using a metal having a defined relationship between temperature and resistivity. In such an exemplary device, the metal may be formed as a track between two layers of suitable insulating materials. An external heating element formed in this manner may be used to both heat and monitor the temperature of the external heating element during operation.

The heating element advantageously heats the aerosol-forming substrate by means of heat conduction. The heating element may be at least partially in contact with the substrate, or the carrier on which the substrate is deposited. Alternatively, the heat from either an internal or external heating element may be conducted to the substrate by means of a heat conductive element.

During operation, the aerosol-forming substrate may be completely contained within the aerosol-generating device. In that case, a user may puff on a mouthpiece of the aerosol-generating device. Alternatively, during operation, a smoking article containing the aerosol-forming substrate may be partially contained within the aerosol-generating device. In that case, the user may puff directly on the smoking article.

The heating element may be configured as an induction heating element. The induction heating element may comprise an induction coil and a susceptor. In general, a susceptor is a material that is capable of generating heat, when penetrated by an alternating magnetic field. According to the invention, the susceptor may be electrically conductive or magnetic or both electrically conductive and magnetic. An alternating magnetic field generated by one or several induction coils heat the susceptor, which then transfers the heat to the aerosol-forming substrate, such that an aerosol is formed. The heat transfer may be mainly by conduction of heat. Such a transfer of heat is best, if the susceptor is in close thermal contact with the aerosol-forming substrate. When an induction heating element is employed, the induction heating element may be configured as an internal heating element as described herein or as an external heater as described herein. If the induction heating element is configured as an internal heating element, the susceptor element is preferably configured as a pin or blade for penetrating the aerosol-generating article. If the induction heating element is configured as an external heating element, the susceptor element is preferably configured as a cylindrical susceptor at least partly surrounding the cavity or forming the sidewall of the cavity.

The heating chamber may comprise a central region comprising the heating element. The term central region refers to the longitudinal direction. The heating chamber may further comprise a proximal region and a distal region. The proximal region and the distal region may be distanced from the heating element in a longitudinal direction. During use, the proximal and distal regions may be colder than the central region of the heating chamber. The first and second connecting walls may contact the heating chamber in the proximal and distal regions, respectively. The first and second connecting walls may thus contact the heating chamber at the coldest points of the heating chamber during use. Thereby, heat losses from the heating chamber to the connecting walls and the heater casing may be additionally reduced. Thermal insulation may be additionally improved.

The wall of the heating chamber may be made of stainless steel. This may beneficially enhance the effect that, during use, the proximal region and the distal region may be colder than the central region of the heating chamber.

The invention further relates to an aerosol-generating device comprising the heater assembly as described herein.

Preferably, the aerosol-generating device comprises a power supply configured to supply power to the heating element. The power supply preferably comprises a power source. Preferably, the power source is a battery, such as a lithium ion battery. As an alternative, the power source may be another form of charge storage device such as a capacitor. The power source may require recharging. For example, the power source may have sufficient capacity to allow for the continuous generation of aerosol for a period of around six minutes or for a period that is a multiple of six minutes. In another example, the power source may have sufficient capacity to allow for a predetermined number of puffs or discrete activations of the heater assembly.

The power supply may comprise control electronics. The control electronics may comprise a microcontroller. The microcontroller is preferably a programmable microcontroller. The electric circuitry may comprise further electronic components. The electric circuitry may be configured to regulate a supply of power to the heater assembly. Power may be supplied to the heater assembly continuously following activation of the system or may be supplied intermittently, such as on a puff-by-puff basis. The power may be supplied to the heater assembly in the form of pulses of electrical current.

The invention further relates to an aerosol-generating system comprising the aerosol-generating device as described herein and an aerosol-forming substrate configured to be at least partly inserted into the heating chamber. The aerosol-forming substrate may be part of an aerosol-generating article and the aerosol-generating article may be configured to be at least partly inserted into the heating chamber.

As used herein, the term "aerosol-forming substrate" refers to a substrate capable of releasing volatile compounds that can form an aerosol. The volatile compounds may be released by heating or combusting the aerosol-forming substrate. As an alternative to heating or combustion, in some cases, volatile compounds may be released by a chemical reaction or by a mechanical stimulus, such as ultrasound. The aerosol-forming substrate may be solid or liquid or may comprise both solid and liquid components. An aerosol-forming substrate may be part of an aerosol-generating article.

As used herein, the term "aerosol-generating article" refers to an article comprising an aerosol-forming substrate that is capable of releasing volatile compounds that can form an aerosol. An aerosol-generating article may be disposable.

As used herein, the term "aerosol-generating device" refers to a device that interacts with an aerosol-forming substrate to generate an aerosol. An aerosol-generating device may interact with one or both of an aerosol-generating article comprising an aerosol-forming substrate, and a cartridge comprising an aerosol-forming substrate. In some examples, the aerosol-generating device may heat the aerosol-forming substrate to facilitate release of volatile compounds from the substrate. An electrically operated aerosol-generating device may comprise an atomiser, such as an electric heater, to heat the aerosol-forming substrate to form an aerosol.

As used herein, the term "aerosol-generating system" refers to the combination of an aerosol-generating device with an aerosol-forming substrate. When the aerosol-forming substrate forms part of an aerosol-generating article, the aerosol-generating system refers to the combination of the aerosol-generating device with the aerosol-generating article. In the aerosol-generating system, the aerosol-forming substrate and the aerosol-generating device cooperate to generate an aerosol.

Below, there is provided a non-exhaustive list of non-limiting examples. Any one or more of the features of these examples may be combined with any one or more features of another example, embodiment, or aspect described herein.

Example A: A heater assembly for an aerosol-generating device, comprising

- a heating chamber for heating an aerosol-forming substrate,
- a heater casing arranged around the heating chamber, wherein the heater casing is arranged radially distanced from the heating chamber;
- a first connecting wall and a second connecting wall; and an air-tight hollow space defined between the heating chamber, the heater casing, and the first and second connecting walls.

Example B: The heater assembly according to Example A, wherein a distance between the heating chamber and the heater casing is between 2.5 millimeters and 7 millimeters.

Example C: The heater assembly according to Example B, wherein the distance between the heating chamber and the heater casing is between 3.5 millimeters and 6 millimeters, preferably about 4.6 millimeters.

Example D: The heater assembly according to any of the preceding examples, wherein the air-tight hollow space is filled with a gaseous composition at ambient pressure.

Example E: The heater assembly according to Example D, wherein the air-tight hollow space is filled with ambient air.

Example F: The heater assembly according to any of the preceding examples, wherein the connecting walls sealingly connect the heater casing with an outer wall of the heating chamber.

Example G: The heater assembly according to any of the preceding examples, wherein the connecting walls are oriented perpendicular to a longitudinal axis of the heating chamber.

Example H: The heater assembly according to any of the preceding examples, wherein the heating chamber has an elongate shape.

Example I: The heater assembly according to Example H, wherein the heating chamber is a hollow tube.

Example J: The heater assembly according to Example H or Example I, wherein the heating chamber comprises a central region comprising a heating element;

- a proximal region; and
- a distal region
- wherein the proximal region and the distal region are distanced from the heating element in a longitudinal direction, and
- wherein the first and second connecting walls contact the heating chamber in the proximal and distal regions, respectively.

Example K: The heater assembly according to any of the preceding examples, wherein a heating element is arranged at least partly around the heating chamber.

Example L: The heater assembly according to any of the preceding examples, wherein the heating element comprises one or more electrically conductive tracks on an electrically insulating substrate Example M: The heater assembly according to Example L, wherein the heating element is flexible and is wrapped around the heating chamber.

Example N: The heater assembly according to any of Examples K to M, wherein the heating element is arranged between the heating chamber and the heater casing.

Example O: The heater assembly according to any of the preceding examples, wherein the ratio of an external diameter of the heater casing to an external diameter of the heating chamber is between 2 and 3.5.

Example P: The heater assembly according to any of the preceding examples, wherein an external diameter of the heater casing is between 12 millimeters and 20 millimeters, preferably about 17 millimeters.

Example Q: The heater assembly according to any of the preceding examples, wherein an inner side of a wall of the heater casing comprises a metal coating.

Example R: The heater assembly according to any of the preceding examples, wherein a wall of the heating chamber comprises stainless steel.

Example S: The heater assembly according to any of the preceding examples, wherein the thickness of one or more of a wall of the heater casing and the first and second connecting walls is below 2 millimeter, preferably about 0.8 millimeter.

Example T: The heater assembly according to any of the preceding examples, wherein one or more of a wall of the heater casing and the first and second connecting walls comprise a plastic material, preferably a polyaryletherketone (PAEK), a polyether ether ketone (PEEK), or a polyphenylene sulfone (PPSU), more preferably a polyphenylene sulfone (PPSU).

Example U: An aerosol-generating device comprising the heater assembly according to any of the preceding examples.

Example V: An aerosol-generating system comprising the aerosol-generating device according to Example U and an aerosol-forming substrate configured to be at least partly inserted into the heating chamber.

Example W: The aerosol-generating system according to Example V, wherein the system comprises an aerosol-generating article comprising the aerosol-forming substrate, and wherein the aerosol-generating article is configured to be at least partly inserted into the heating chamber.

Features described in relation to one embodiment may equally be applied to other embodiments of the invention.

The invention will be further described, by way of example only, with reference to the accompanying drawings in which.

Figure 1:
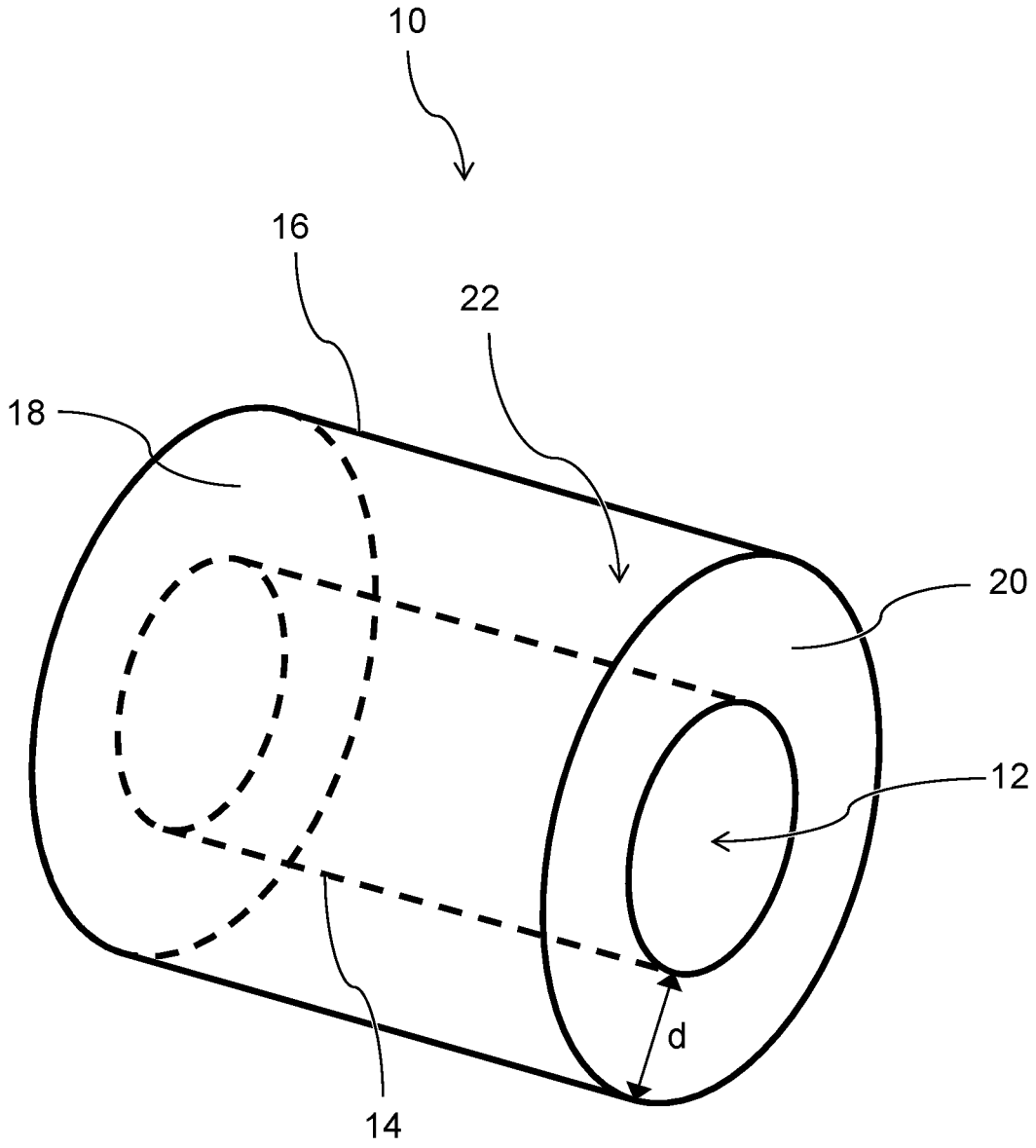
FIG. 1 shows an embodiment of a heater assembly for an aerosol-generating device.

FIG. 1 schematically shows a heater assembly 10. The heater assembly 10 comprises a heating chamber 12 for heating an aerosol-forming substrate. The heating chamber 12 has an elongate shape. The heating chamber 12 comprises a wall of the heating chamber 14 circumscribing a cavity for insertion of the aerosol-forming substrate. The wall of the heating chamber 14 forms a hollow tube. The heater assembly 10 further comprises a heater casing. The heater casing is arranged coaxially around the heating chamber 12. The heater casing comprises a cylindrical wall of the heater casing 16. The heater casing is further arranged radially distanced from the heating chamber 12 at a distance d. The distance d is measured in a radial direction between the outer diameter of the hollow tube formed by the wall of the heating chamber 14 and the inner diameter of the cylindrical wall of the heater casing 16. The wall of the heating chamber 14 and the wall of the heater casing 16 have matching shapes. Thereby, the distance d is constant along the longitudinal axis of the heating chamber 12.

The heater assembly 10 further comprises a first connecting wall 18 at a proximal end of the heater assembly 10. The heater assembly 10 further comprises a second connecting wall 20 at a distal end of the heater assembly 10. The first and second connecting walls 18, 20 are oriented perpendicular to a longitudinal axis of the heating chamber 12. The heater assembly 10 further comprises an air-tight hollow space 22. The air-tight hollow space 22 is defined between the wall of the heating chamber 14, the wall of the heater casing 16, and the first and second connecting walls 18, 20.

Figure 2:
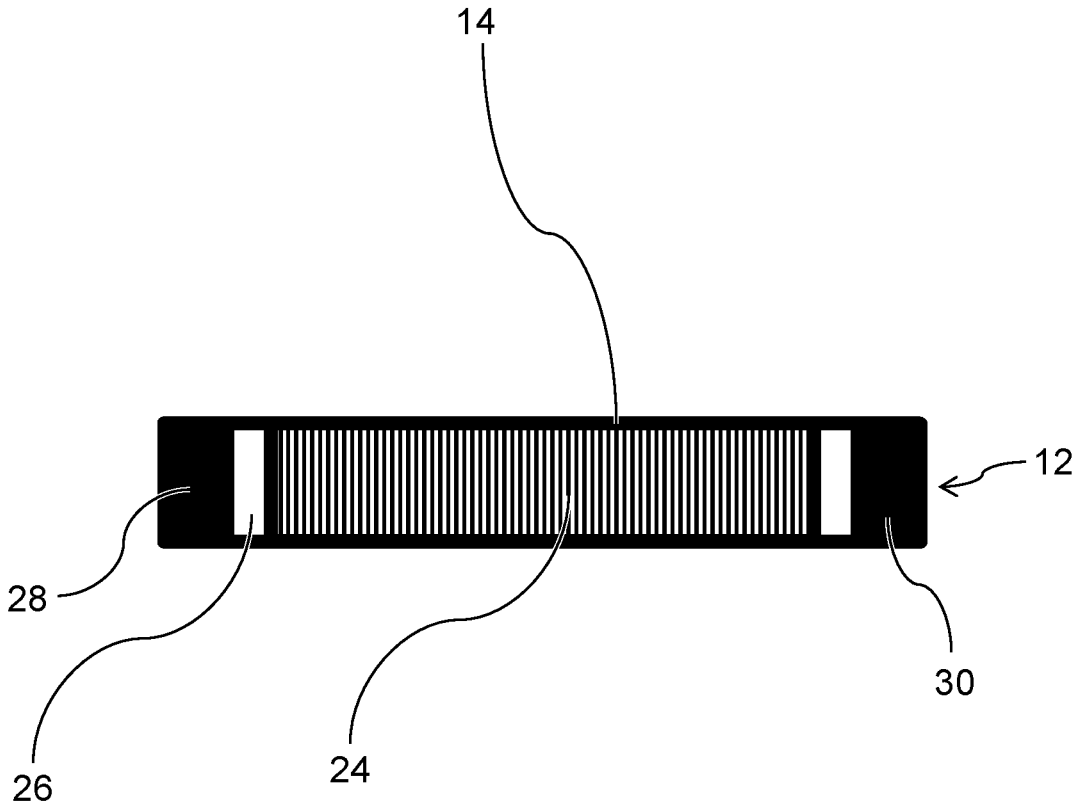
FIG. 2 shows an embodiment of a heating chamber of a heater assembly.

FIG. 2 shows an embodiment of a heating chamber 12. The heating chamber 12 comprises a central region comprising a heating element. The heating element is arranged partly around the heating chamber 12. The wall of the heating chamber 14 is a metal tube. The heating element is flexible and is wrapped around the metal tube. The heating element comprises electrically conductive heating tracks 24 on an electrically insulating flexible substrate 26. In the embodiment shown, proximal and distal edge portions of the flexible substrate 26 are not covered by the heating tracks 24. In other embodiments, different regions or even the whole surface of the flexible substrate 26 may be covered by the heating tracks 24. A proximal region 28 and a distal region 30 of the heating chamber 12 are distanced from the heating element in a longitudinal direction.

Figure 3:
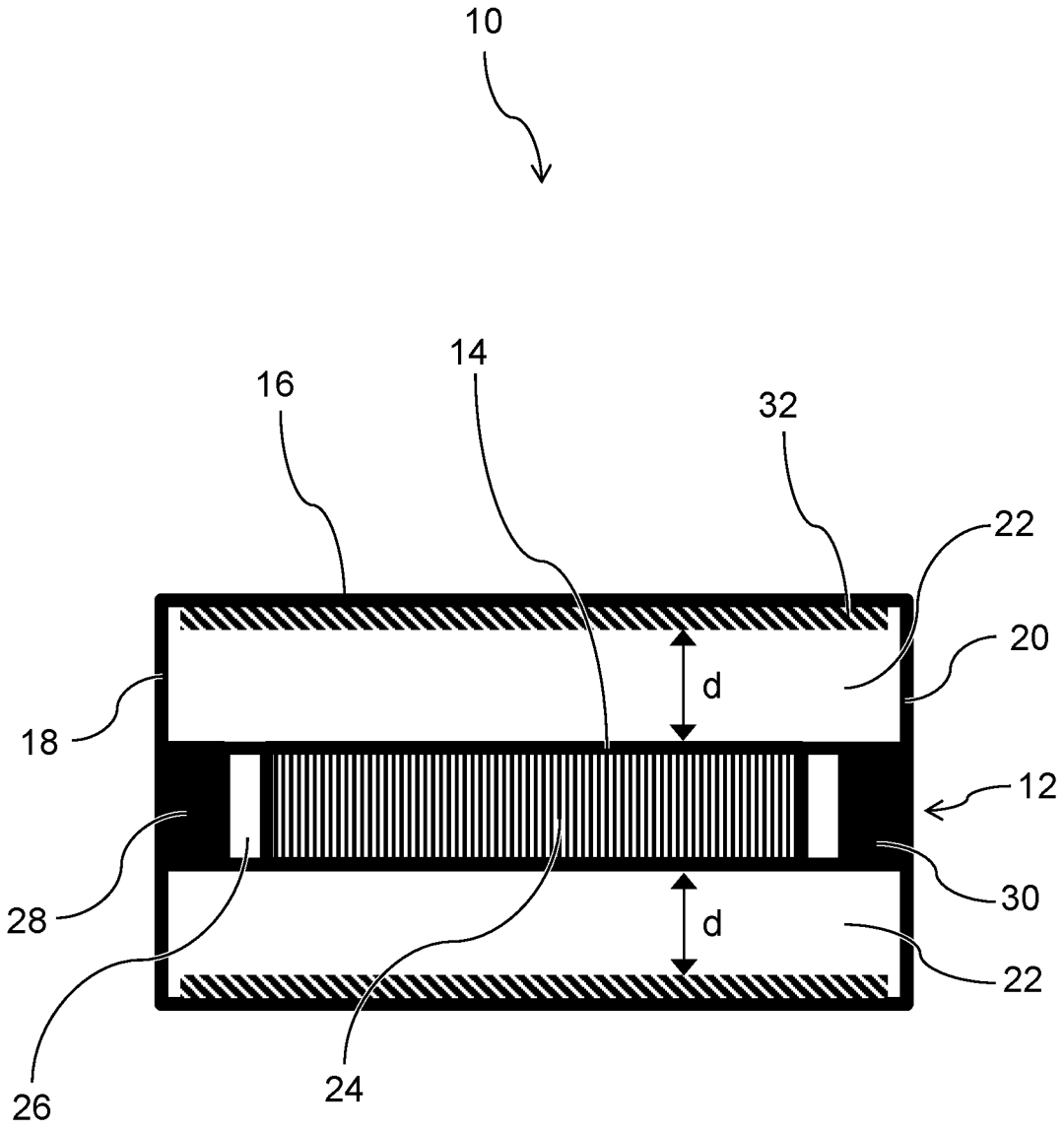
FIG. 3 shows an embodiment of a heater assembly for an aerosol-generating device.

FIG. 3 shows an embodiment of a heater assembly 10 comprising the heating chamber 12 of FIG. 2. The heating element is arranged between the heating chamber 12 and the heater casing.

The first and second connecting walls 18, 20 sealingly connect the wall of the heater casing 16 with the wall of the heating chamber 14, thereby air-tightly enclosing the air-tight hollow space 22.

The first and second connecting walls 18, 20 contact the heating chamber 12 in the proximal and distal regions 28, 30, respectively. The first and second connecting walls 18, 20 contact the heating chamber 12 at positions distanced from the heating element. The first and second connecting walls 18, 20 thus contact the heating chamber 12 at the coldest points of the heating chamber when being heated during use. Thereby, heat losses due to heat transport from the heating chamber 12 to the connecting walls 18, 20 and the heater casing via thermal conduction are additionally reduced. Thermal insulation may be additionally improved.

An inner side of the wall of the heater casing 16 comprises a metal coating 32. The metal coating 32 may reflect heat emitted from the heating chamber 12 back towards the heating chamber. Thereby, thermal insulation of the heating chamber with respect to the outside of the heater casing may be improved.

The distance d is measured in a radial direction between the heating element on the outer side of the wall of the heating chamber 14 and the metal coating 32 on the inner side of the wall of the heater casing 16.

Figure 4:
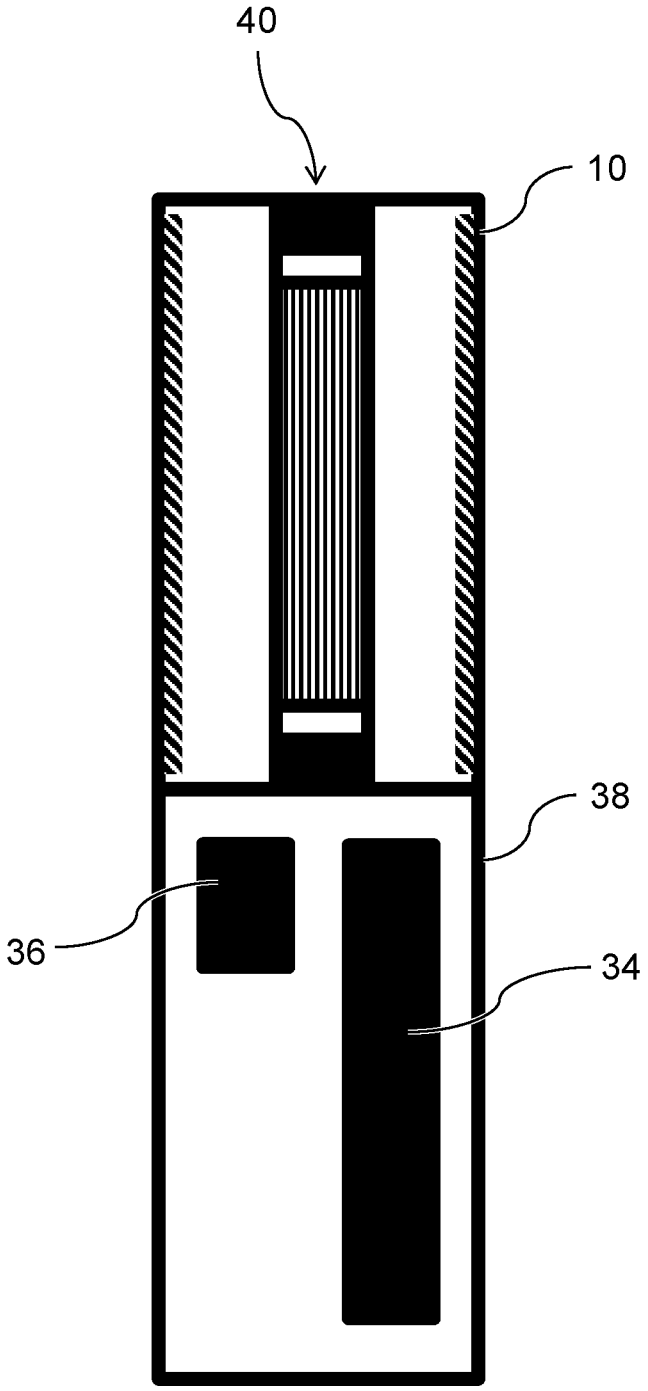
FIG. 4 shows an embodiment of an aerosol-generating device.

FIG. 4 shows an embodiment of an aerosol-generating device comprising the heater assembly 10 of FIG. 3. The aerosol-generating device further comprises a power supply. The power supply comprises a power source 34 and control electronics 36. The power source 34 may be a rechargeable battery. In the embodiment of FIG. 4, the wall of the heater casing 16 forms part of an outer housing 38 of the aerosol-generating device.

At opening 40, the aerosol-forming substrate may be inserted at least partly into the heating chamber 12.

Figure 5:
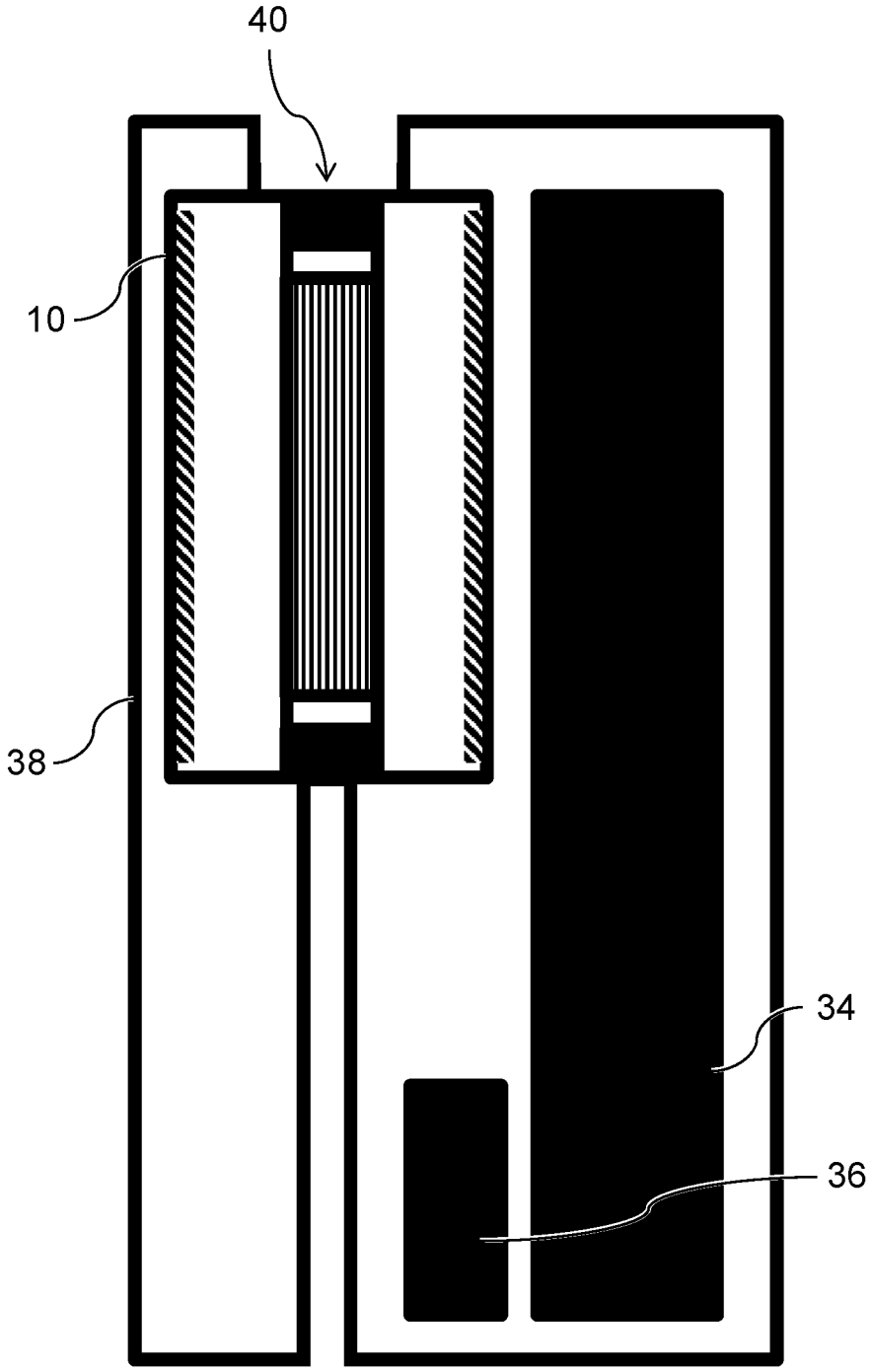
FIG. 5 shows an embodiment of an aerosol-generating device.

FIG. 5 shows an embodiment of an aerosol-generating device comprising the heater assembly 10 of FIG. 3. In difference to the embodiment of FIG. 4, in the embodiment of FIG. 5, the heater assembly 10 is arranged within a separate outer housing 38 of the aerosol-generating device.

The invention claimed is:

1. A heater assembly for an aerosol-generating device, comprising:

a heating chamber configured to heat an aerosol-forming substrate;

a heater casing arranged around the heating chamber, wherein the heater casing is arranged radially distanced from the heating chamber;

a first connecting wall and a second connecting wall; and an air-tight hollow space defined between the heating chamber, the heater casing, and the first and the second connecting walls, wherein the air-tight hollow space is filled with a gaseous composition at ambient pressure, wherein a heating element is arranged at least partly around the heating chamber, wherein the beating element is arranged between the heating chamber and the heater casing, wherein the first and the second connecting walls sealingly connect the heater casing with an outer wall of the heating chamber, wherein the first and second connecting walls extend between the wall of the heating chamber and a wall of the heater casing, wherein the connecting walls are oriented perpendicular to the longitudinal axis of the heating chamber, wherein one or more of a wall of the heater casing and the first and the second connecting walls comprise a plastic material, wherein the plastic material is a polyaryletherketone (PAEK), a polyether ether ketone (PEEK), or a polyphenylene sulfone (PPSU), wherein an inner side of a wall of the heater casing comprises a metal coating, and wherein the air-tight hollow space is defined between the wall of the heating chamber, the wall of the heater casing and the first and second connecting walls.

2. The heater assembly according to claim 1, wherein a distance between the heating chamber and the heater casing is between 2.5 millimeters and 7 millimeters.

3. The heater assembly according to claim 2, wherein the distance between the heating chamber and the heater casing is between 3.5 millimeters and 6 millimeters.

4. The heater assembly according to claim 1, wherein the air-tight hollow space is filled with ambient air.

5. The heater assembly according to claim 1, wherein the first and the second connecting walls are oriented perpendicular to a longitudinal axis of the heating chamber.

6. The heater assembly according to claim 1, wherein the heating chamber has an elongate shape.

7. The heater assembly according to claim 6, wherein the heating chamber is a hollow tube.

8. The heater assembly according to claim 6, wherein the heating chamber comprises a central region comprising a heating element, a proximal region, and a distal region, wherein the proximal region and the distal region are distanced from the heating element in a longitudinal direction, and wherein the first and the second connecting walls contact the heating chamber in the proximal and the distal regions, respectively.

9. The heater assembly according to claim 1, wherein the heating element comprises one or more electrically conductive tracks on an electrically insulating substrate.

10. The heater assembly according to claim 9, wherein the heating element is flexible and is wrapped around the heating chamber.

11. The heater assembly according to claim 1, wherein a ratio of an external diameter of the heater casing to an external diameter of the heating chamber is between 2 and 3.5.

12. The heater assembly according to claim 1, wherein an external diameter of the heater casing is between 12 millimeters and 20 millimeters.

13. The heater assembly according to claim 1, wherein a wall of the heating chamber comprises stainless steel.

14. The heater assembly according to claim 1, wherein a thickness of one or more of a wall of the heater casing and the first and the second connecting walls is less than 2 millimeters.

15. An aerosol-generating device comprising the heater assembly according to claim 1.

16. An aerosol-generating system comprising the aerosol-generating device according to claim 15 and an aerosol-forming substrate configured to be at least partly inserted into the heating chamber.

17. The aerosol-generating system according to claim 16, the aerosol-generating system comprising an aerosol-generating article comprising the aerosol-forming substrate, wherein the aerosol-generating article is configured to be at least partly inserted into the heating chamber.

18. The heater assembly according to claim 1, wherein the heater casing is coaxially aligned around the heating chamber, and wherein the heater casing and the heating chamber have matching shapes such that a radial distance between the heater casing and the heating chamber is substantially constant along a longitudinal axis of the heating chamber.

* * * * *